US008998385B2

(12) United States Patent
Morooka et al.

(10) Patent No.: US 8,998,385 B2
(45) Date of Patent: Apr. 7, 2015

(54) THERMAL HEAD, PRINTER, AND METHOD OF MANUFACTURING THERMAL HEAD

(71) Applicant: Seiko Instruments Inc., Chiba-shi, Chiba (JP)

(72) Inventors: Toshimitsu Morooka, Chiba (JP); Keitaro Koroishi, Chiba (JP); Noriyoshi Shoji, Chiba (JP); Norimitsu Sanbongi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 13/722,092

(22) Filed: Dec. 20, 2012

(65) Prior Publication Data

US 2013/0169729 A1 Jul. 4, 2013

(30) Foreign Application Priority Data

Dec. 28, 2011 (JP) ..... 2011-289962

(51) Int. Cl.
*B41J 2/05* (2006.01)
*B41J 2/335* (2006.01)

(52) U.S. Cl.
CPC ..... *B41J 2/3351* (2013.01); *B41J 2/3359* (2013.01); *B41J 2/33545* (2013.01); *B41J 2/3355* (2013.01); *B41J 2/3357* (2013.01); *B41J 2/33585* (2013.01)

(58) Field of Classification Search
None
See application file for complete search history.

(56) References Cited

U.S. PATENT DOCUMENTS

| | | | | |
|---|---|---|---|---|
| 7,768,541 | B2 | 8/2010 | Koroishi et al. | |
| 2009/0219728 | A1 * | 9/2009 | Hata et al. | 362/382 |
| 2011/0063396 | A1 * | 3/2011 | Morooka et al. | 347/205 |

FOREIGN PATENT DOCUMENTS

JP 2009-119850 A 6/2009

* cited by examiner

*Primary Examiner* — Matthew Luu
*Assistant Examiner* — Erica Lin
(74) *Attorney, Agent, or Firm* — Brinks Gilson & Lione

(57) ABSTRACT

A thermal head including: a laminated substrate including a support substrate and an upper substrate at least one of which has a recess formed in a surface thereof; a heat generating resistor formed on a surface of the upper substrate in the laminated substrate at a position opposed to the recess; and a pair of electrode portions connected to each of both ends of a heat generating resistor, wherein the laminated substrate further includes: an intermediate metal layer sandwiched between the support substrate and the upper substrate and bonded thereto in a laminated state; and a surrounding metal layer formed of a metal material, the surrounding metal layer provided in contact with the intermediate metal layer and formed from a surface of the support substrate extending in a thickness direction thereof to a surface thereof opposite to a portion bonded to the upper substrate.

21 Claims, 12 Drawing Sheets

THERMAL HEAD, PRINTER, AND METHOD OF MANUFACTURING THERMAL HEAD

RELATED APPLICATIONS

This application claims priority under 35 U.S.C. §119 to Japanese Patent Application No. 2011-289962 filed on Dec. 28, 2011, the entire content of which is hereby incorporated by reference.

BACKGROUND OF THE INVENTION

1. Field of the Invention

The present invention relates to a thermal head, a printer, and a method of manufacturing a thermal head.

2. Description of the Related Art

Conventionally, as a thermal head used in a thermal printer, one in which a plurality of heat generating resistors and electrode portions are formed on a laminated substrate of a support substrate and an upper substrate which are formed of the same glass material is known. The thermal head is configured to print on a heat-sensitive recording medium or the like by causing the heat generating resistor to generate heat through supply of electric power to the electrode portion.

Further, the thermal head has a cavity portion in a bonded portion of the support substrate and the upper substrate in a region which is opposed to the heat generating resistor. The cavity portion functions as a heat insulating layer, thereby reducing the amount of heat transferred from the heat generating resistor via the upper substrate to the support substrate side. Further, by forming the support substrate of a glass material having a low thermal conductivity, heat transferred via the cavity portion to the support substrate side is stored in the support substrate to raise the temperature of the entire surface of the thermal head. In other words, due to high heat insulating performance of the cavity portion immediately below the heat generating resistor and a thermal storage effect of the support substrate made of a glass material, the thermal head uses heat generated by the heat generating resistor more efficiently to realize high heat generating efficiency.

An application period for a thermal head, during which one print dot is formed on a heat-sensitive recording medium, includes heating time for heating the heat generating resistor for printing, and non-heating time for cooling the heated heat generating resistor. While the rise time of the temperature during the heating time is proportional to a thermal capacity C around a heat generating portion of the thermal head, the fall time of the temperature during the non-heating time depends on the thermal capacity C and a thermal conductivity G of the thermal head and is proportional to C/G.

In this thermal head, while the cavity portion reduces the thermal capacity to obtain a fast response characteristic of the heat generating resistor during the heating time, the temperature of the heat generating resistor which has once increased is less liable to fall due to the thermal storage effect of the support substrate, and thus, the response characteristic of the heat generating resistor during the non-heating time is slow to prolong the non-heating time.

Accordingly, in this field, a thermal head and a printer which can attain both higher printing speed and reduced power consumption, and a manufacturing method which can manufacture such a thermal head with ease are desired.

SUMMARY OF THE INVENTION

According to an exemplary embodiment of the present invention, there is provided a thermal head including: a laminated substrate including a support substrate and an upper substrate which are formed of the same glass material and at least one of which has a recess formed in a surface thereof, the support substrate and the upper substrate being provided in a laminated state so as to enclose the recess, the laminated substrate having a cavity portion between the support substrate and the upper substrate due to the recess; a heat generating resistor formed on a surface of the upper substrate in the laminated substrate at a position opposed to the cavity portion; and a pair of electrode portions connected to each of both ends of the heat generating resistor, for supplying electric power to the heat generating resistor. The laminated substrate further includes: an intermediate metal layer which is formed of a metal material, the intermediate metal layer being sandwiched between the support substrate and the upper substrate and being bonded thereto in a laminated state; and a surrounding metal layer which is formed of a metal material, the surrounding metal layer being provided in contact with the intermediate metal layer and being formed from a surface of the support substrate extending in a thickness direction thereof to a surface thereof opposite to a portion bonded to the upper substrate.

According to this exemplary embodiment, the upper substrate provided immediately below the heat generating resistor functions as a thermal storage layer for storing heat. Further, the cavity portion formed in a region opposed to the heat generating resistor functions as a hollow heat insulating layer for insulating heat. The cavity portion can reduce the amount of heat generated by and transferred from the heat generating resistor via the upper substrate as a thermal storage layer to the support substrate side to reduce the thermal capacity. This enables efficient use of heat generated by the heat generating resistor to improve the heat generating efficiency.

On the other hand, heat transferred from the upper substrate via the cavity portion to the support substrate side is transferred via the intermediate metal layer and the surrounding metal layer which are formed of a metal material having a high thermal conductivity to the side of the surface of the support substrate opposite to the bonded portion (hereinafter referred to as lower surface of the laminated substrate). With this, by fixing the lower surface of the laminated substrate onto a heat sink for dissipating heat, heat stored in the support substrate can be efficiently dissipated to facilitate cooling of the heat generating resistor.

Therefore, by, with the cavity portion, reducing the thermal capacity to improve the response characteristic during heating time for heating the heat generating resistor and reducing the thermal storage effect of the support substrate to improve the response characteristic during non-heating time for cooling the heat generating resistor, both reduced power consumption and higher printing speed can be attained. Further, by forming the upper substrate and the support substrate of the same glass material, difference in thermal expansion coefficient between the substrates can be eliminated to prevent warpage and distortion of the heat generating resistor due to generated heat, thereby maintaining high print quality.

In the above-mentioned exemplary embodiment, the surrounding metal layer may be formed in an entire region of the surface of the support substrate except for the bonded portion.

This structure enables increase in the amount of heat transferred from the intermediate metal layer via the surrounding metal layer to the lower surface of the laminated substrate to improve the effect of dissipating heat stored in the support substrate.

Further, in the above-mentioned exemplary embodiment, the intermediate metal layer may be formed in an entire region of the surface of the upper substrate in the bonded portion.

This structure enables reduction in thermal storage effect of the upper substrate to improve the printing speed.

Further, in the above-mentioned exemplary embodiment, the intermediate metal layer may be formed in an entire region of the surface of the support substrate in the bonded portion.

Further, in the above-mentioned exemplary embodiment, the recess may be formed in the surface of the support substrate, and the intermediate metal layer may be formed on the bonded surface of the support substrate in the bonded portion and on an inner wall surface of the recess.

This structure enables reduction in thermal storage effect of the support substrate to improve the printing speed. Further, the necessity of patterning the intermediate metal layer on the upper substrate is eliminated, which can facilitate the manufacture.

Further, in the above-mentioned exemplary embodiment, the support substrate may include a through hole which passes through the support substrate in a thickness direction thereof to form the recess, and the surrounding metal layer may extend via an inner wall surface of the through hole toward a surface of the support substrate which is opposite to the bonded portion.

This structure causes heat transferred to the support substrate to be dissipated via the surrounding metal layer formed on the inner wall surface of the through hole formed immediately below the heat generating resistor. Therefore, the heat dissipation efficiency by the surrounding metal layer can be improved to further reduce the thermal storage effect of the support substrate.

Further, in the above-mentioned exemplary embodiment, the upper substrate and the support substrate may be formed of a glass material which contains movable ions and may be bonded together through intermediation of the intermediate metal layer by anode bonding.

In this structure, the upper substrate and the support substrate are bonded together by anode bonding at a temperature under the softening point of the upper substrate and the support substrate. Therefore, the accuracy of form of the upper substrate and the support substrate can be maintained to improve the reliability. Further, by adopting anode bonding, the choice of the glass material for the upper substrate and the support substrate can be widened.

Further, in the above-mentioned exemplary embodiment, the upper substrate and the support substrate may each include the intermediate metal layer on the bonded surface thereof, and may be bonded together by one of eutectic bonding and diffusion bonding of the intermediate metal layers.

In a eutectic alloy, metals or compounds therein having different melting points crystallize out at the same time under a state of being molten or finely mixed at a predetermined temperature which is lower than the melting points of the two substances, and thus, by using as the intermediate metal layers a metal material forming the eutectic, bonding can be carried out at a low temperature. In eutectic bonding, for example, Sn—Au is used. On the other hand, in diffusion bonding, for example, Au—Ag, Au—Al, or Au—Au is used.

Further, according to another exemplary embodiment of the present invention, there is provided a printer, including: the thermal head according to the above-mentioned exemplary embodiment; and a pressure mechanism for pressing a heat-sensitive recording medium against the heat generating resistor of the thermal head and feeding the heat-sensitive recording medium.

According to the above-mentioned another exemplary embodiment, with the thermal head which attains both higher printing speed and reduced power consumption, printing on thermal paper can be carried out using low electric power at high speed. Therefore, the duration of a battery can be prolonged.

Further, according to still another exemplary embodiment of the present invention, there is provided a method of manufacturing a thermal head, including: forming an intermediate metal layer formed of a metal material on at least one of a surface of a plate-like support substrate and a surface of a plate-like upper substrate which are opposed to each other and at least one of which has a recess formed therein; bonding the support substrate and the upper substrate in a laminated state with the intermediate metal layer sandwiched therebetween so as to enclose an opening of the recess and form a cavity portion, to thereby form a laminated substrate; forming a heat generating resistor on a surface of the upper substrate at a position opposed to the recess, the upper substrate being bonded to the support substrate with the intermediate metal layer sandwiched therebetween in the bonding; and forming a surrounding metal layer formed of a metal material so as to be provided in contact with the intermediate metal layer and extend from a surface of the support substrate extending in a thickness direction thereof to a surface thereof opposite to the opposed surface.

According to the above-mentioned still another exemplary embodiment, by, in the bonding step, bonding the upper substrate and the support substrate in the laminated state with the intermediate metal layer sandwiched therebetween so as to enclose the recess, the laminated substrate is formed to have the cavity portion between the upper substrate and the support substrate. The cavity portion functions as a hollow heat insulating layer for insulating heat transferred from the upper substrate to the support substrate side. Further, by, in the resistor forming step, forming the heat generating resistor on the surface of the upper substrate in the laminated substrate at a position opposed to the cavity portion, the amount of heat which is generated by the heat generating resistor and which escapes to the upper substrate side can be controlled by heat insulation with the cavity portion, to thereby increase the usable amount of heat.

Further, by, in the surrounding metal layer forming step, forming the surrounding metal layer brought into contact with the intermediate metal layer from the surface of the support substrate extending in the thickness direction thereof to the surface opposite to the portion thereof bonded to the upper substrate, heat transferred from the upper substrate via the cavity portion to the support substrate side can be transferred via the intermediate metal layer and the surrounding metal layer which are formed of a metal material having a high thermal conductivity to the side of the surface of the support substrate opposite to the bonded portion (hereinafter referred to as lower surface of the laminated substrate). With this, by fixing the lower surface of the laminated substrate onto a heat sink for dissipating heat, heat stored in the support substrate can be efficiently dissipated to facilitate cooling of the heat generating resistor.

Therefore, by, with the cavity portion, reducing the thermal capacity to improve the response characteristic during heating time for heating the heat generating resistor and reducing the thermal storage effect of the support substrate to improve the response characteristic during non-heating time for cooling the heat generating resistor, it is possible to easily manufacture the thermal head capable of attaining both reduced power consumption and higher printing speed.

According to the above-mentioned exemplary embodiments of the present invention, the thermal head and the printer have the effect of being able to attain both higher printing speed and reduced power consumption. Further, the method of manufacturing a thermal head according to the present invention has the effect of being able to manufacture such a thermal head with ease.

DETAILED DESCRIPTION OF THE PREFERRED EMBODIMENTS

A thermal head, a printer, and a method of manufacturing a thermal head according to an embodiment of the present invention are described in the following with reference to the attached drawings.

Figure 1:
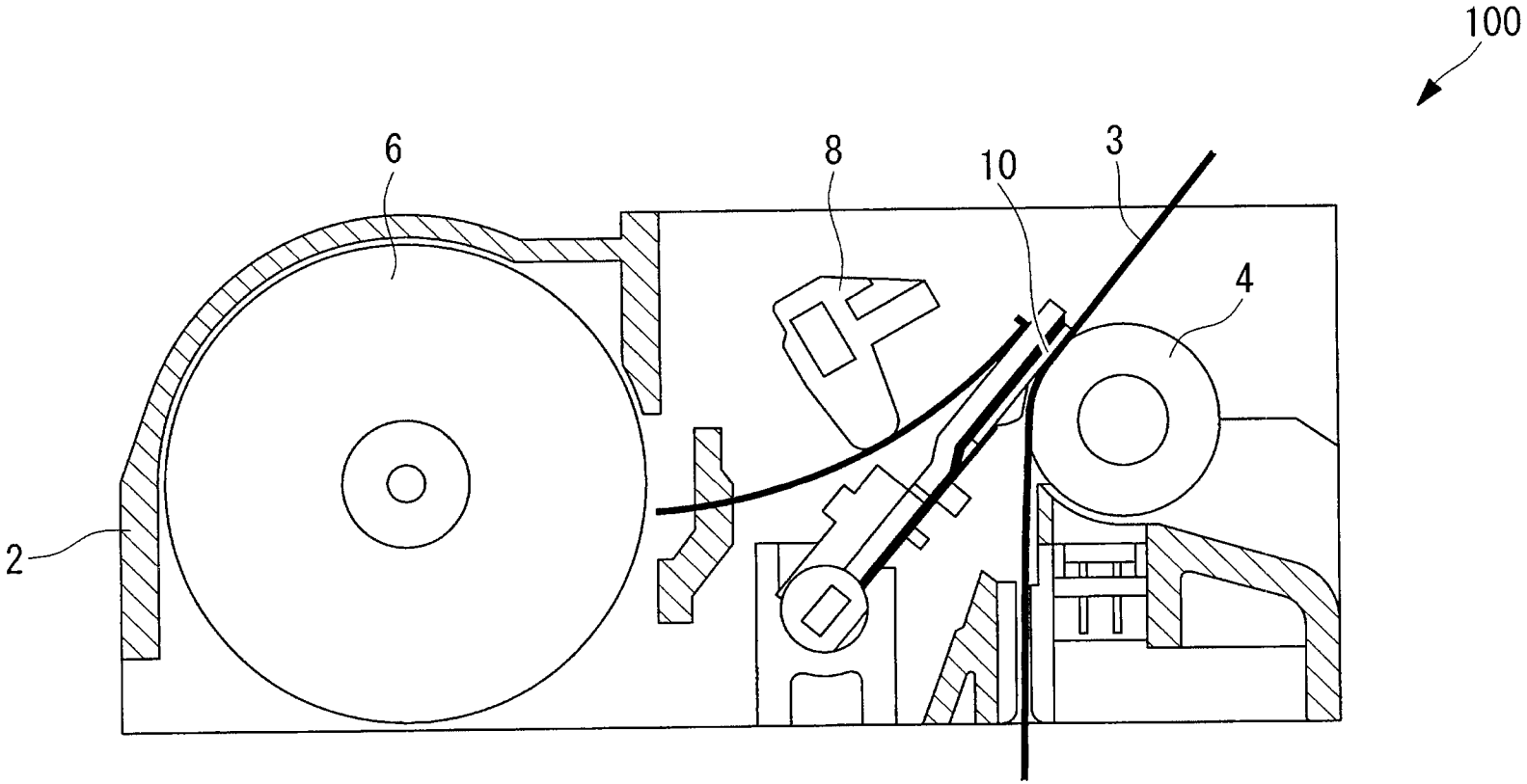
FIG. 1 is a schematic view illustrating a structure of a thermal printer according to an embodiment of the present invention.

As illustrated in FIG. 1, a thermal printer (printer) 100 according to this embodiment includes a body frame 2, a platen roller 4 provided so as to be level, a thermal head 10 provided so as to be opposed to an outer peripheral surface of the platen roller 4, a paper feed mechanism 6 for feeding thermal paper (heat-sensitive recording medium) 3 to a nip between the platen roller 4 and the thermal head 10, and a pressure mechanism 8 for pressing, with predetermined pressing force, the thermal head 10 against the thermal paper 3.

The thermal paper 3 and the thermal head 10 are pressed against the platen roller 4 by the actuation of the pressure mechanism 8. This causes the load by the platen roller 4 to be imposed via the thermal paper 3 on the thermal head 10. By pressing a heat generating portion of the thermal head 10 against the thermal paper 3, the thermal paper 3 exhibits a color to carry out printing.

Figure 2:
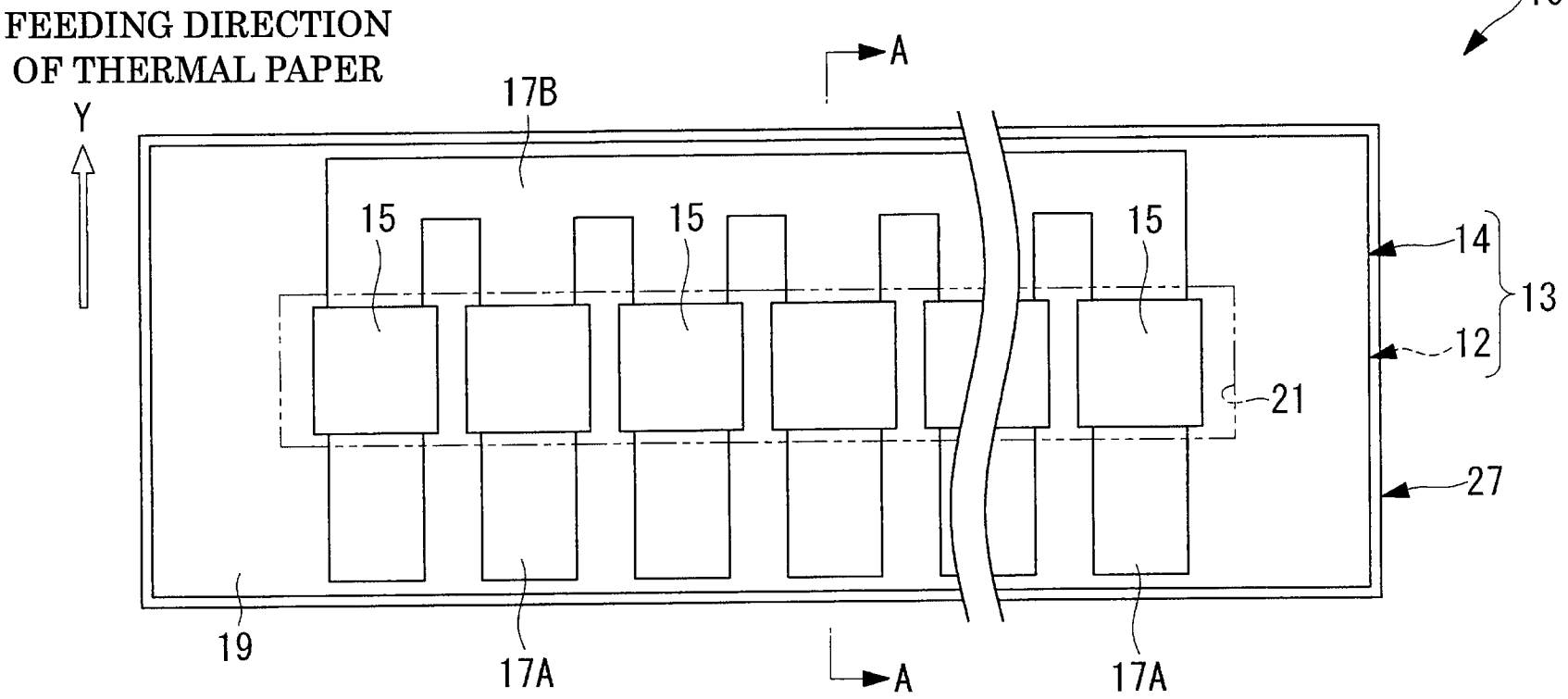
FIG. 2 is a plan view of a thermal head included in the thermal printer illustrated in FIG. 1 seen from a protective film side in a lamination direction.

As illustrated in FIG. 2, the thermal head 10 is formed so as to be substantially plate-like. The thermal head 10 includes a laminated substrate 13 formed of a glass material, a plurality of heat generating resistors 15 formed on the laminated substrate 13, electrode portions 17A and 17B formed on the laminated substrate 13 so as to be provided in contact with the respective heat generating resistors 15, and a protective film 19 which covers the heat generating resistors 15 and the electrode portions 17A and 17B to protect those members against wear and corrosion. The thermal paper 3 is fed by the platen roller 4 in the direction of an arrow Y.

Figure 3:
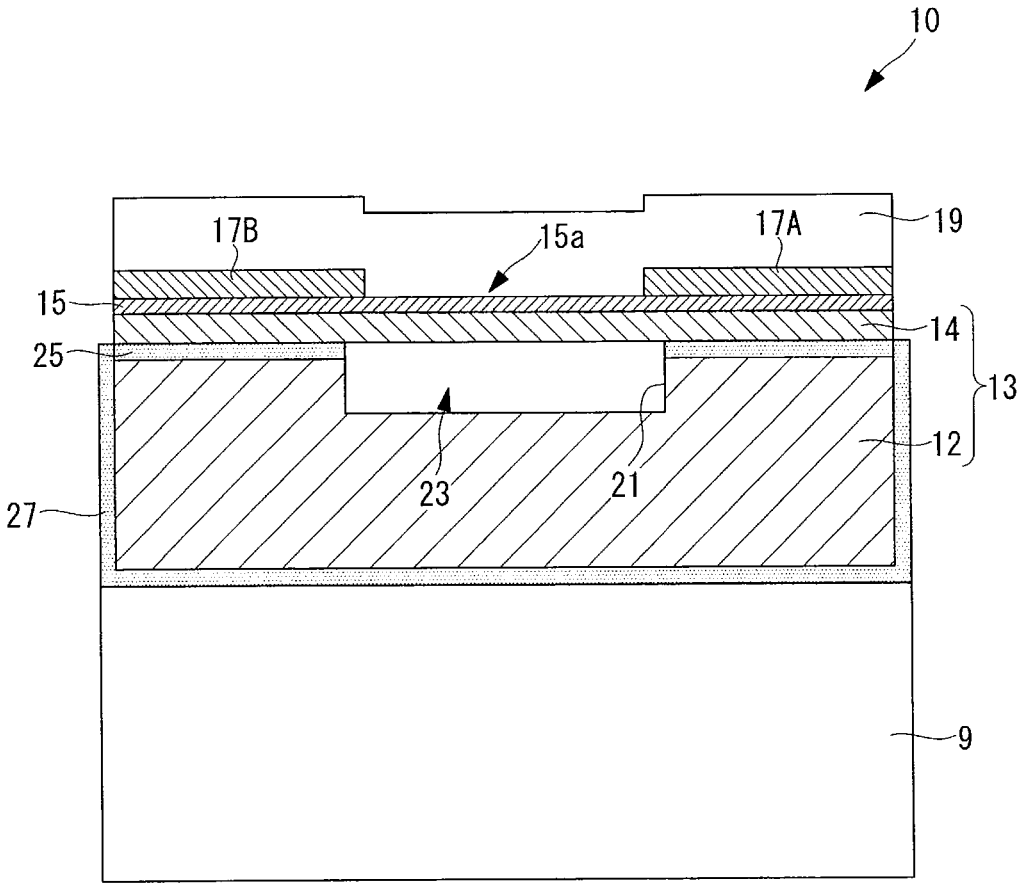
FIG. 3 is a vertical sectional view of the thermal head taken along the line A-A of FIG. 2.

As illustrated in FIG. 3, the laminated substrate 13 is fixed to a heat sink 9 which is a plate-like member formed of a metal such as aluminum, a resin, ceramic, glass, or the like so as to dissipate heat via the heat sink 9. The laminated substrate 13 is formed by providing in a laminated state a plate-like support substrate 12 fixed to the heat sink 9 and a plate-like upper substrate 14 on which the heat generating resistor 15 is formed.

The support substrate 12 is formed of, for example, a plate-like insulator which contains movable ions and has small profile irregularity, such as Pyrex glass (trademark) or soda-lime glass, and has a thickness of about 300 μm to 1 mm. A recess 21 which extends in a longitudinal direction and has a rectangular opening is formed in a surface of the support substrate 12 opposed to the upper substrate 14.

The upper substrate 14 is formed of a plate-like insulator which is the same glass material as the material of the support substrate 12, and has a thickness of about 5 to 100 μm. The upper substrate 14 is provided in a laminated state so as to, together with the surface of the support substrate 12 having the recess 21 formed therein, enclose the recess 21. Further, the heat generating resistor 15 is formed on a surface of the upper substrate 14 provided opposite to the support substrate 12 side, and functions as a thermal storage layer for storing a part of heat generated by the heat generating resistor 15.

Further, the laminated substrate 13 includes an intermediate metal layer 25 formed of a metal material, which is sandwiched between the support substrate 12 and the upper substrate 14 and is bonded thereto in a laminated state, and a surrounding metal layer 27 which is formed of a metal material and which covers the periphery of the support substrate 12. As the intermediate metal layer 25 and the surrounding metal layer 27, a metal material, for example, Au, Al, Cu, Si, Cr, Ti, or Ni, is used.

The intermediate metal layer 25 is formed in the entire region except for the recess 21 in the opposed surface of the support substrate 12 and the upper substrate 14. The intermediate metal layer 25 has a thickness of, for example, about 100 nm.

The surrounding metal layer 27 is, for example, formed from the entire region of a surface of the support substrate 12 extending in a thickness direction thereof (hereinafter referred to as side surfaces of the support substrate 12) to the entire region of a surface of the support substrate 12 opposite to the surface thereof opposed to the upper substrate 14 (hereinafter referred to as lower surface of the support substrate 12). Further, the surrounding metal layer 27 provided on the side surfaces of the support substrate 12 is provided in contact with the intermediate metal layer 25 at all the four side surfaces. The surrounding metal layer 27 also has a thickness of, for example, about 100 nm.

The heat generating resistor 15 is formed of, for example, a Ta-based or Ta silicide-based material, and is formed in the shape of a rectangle. Further, the heat generating resistor 15 has a length in the longitudinal direction which is larger than the width of the recess 21 in the support substrate 12. The heat generating resistors 15 are provided so that the longitudinal direction thereof is the width direction of the upper substrate 14, and are arranged at predetermined intervals along the longitudinal direction of the upper substrate 14 (longitudinal direction of the recess 21 in the support substrate 12).

The electrode portions 17A and 17B include a plurality of individual electrodes 17A each of which is connected to one end of a heat generating resistor 15 in the longitudinal direction, and a common electrode 17B which is common to all the heat generating resistors 15 and is connected to the other end of each of the heat generating resistors 15 in the longitudinal direction. As the electrode portions 17A and 17B, for example, a wiring material such as Al, Al—Si, Au, Ag, Cu, or Pt is used.

These electrode portions 17A and 17B can supply electric power from an external power supply (not shown) to the heat generating resistors 15 to cause the heat generating resistors 15 to generate heat. A region in the heat generating resistor 15 between the individual electrode 17A and the common electrode 17B, that is, a region in the heat generating resistor 15 substantially immediately above the recess 21 in the support substrate 12 is a heat generating portion 15*a*.

The protective film 19 is formed on a surface of the upper substrate 14 which includes the heat generating resistor 15 and the electrode portions 17A and 17B. As the protective film 19, a protective film material such as $SiO_2$, $Ta_2O_5$, SiAlON, $Si_3N_4$, or diamond like carbon is used.

In the thermal head 10 formed in this way, by enclosing the opening of the recess 21 in the support substrate 12 by the upper substrate 14, a cavity portion 23 is formed immediately below the heat generating portion 15*a* of the heat generating resistor 15. The cavity portion 23 has a communicating structure which is opposed to all the heat generating resistors 15. The cavity portion 23 functions as a hollow heat insulating layer for inhibiting transfer of heat generated by the heat generating portion 15*a* of the heat generating resistor 15 from the upper substrate 14 side to the support substrate 12 side.

Figure 4:
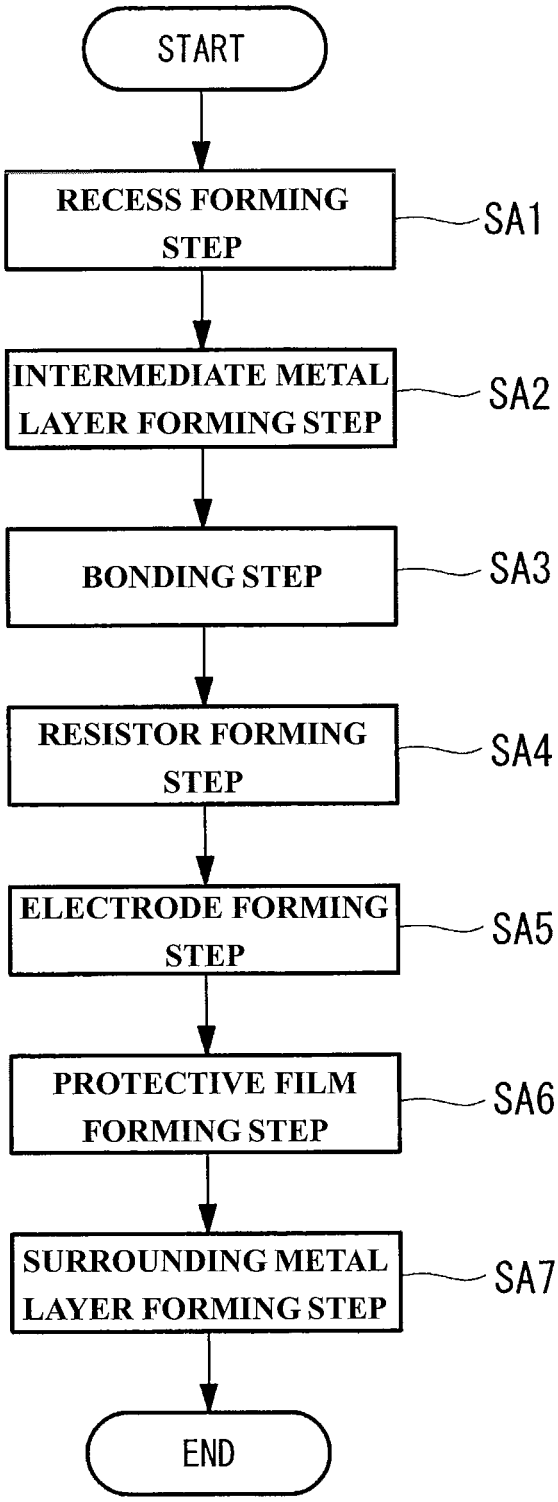
FIG. 4 is a flow chart illustrating a method of manufacturing the thermal head illustrated in FIG. 2.

Next, a method of manufacturing the thermal head 10 formed in this way is described with reference to a flow chart of FIG. 4.

The method of manufacturing the thermal head 10 according to this embodiment includes a heat insulating substrate forming step which includes a recess forming step SA1, an intermediate metal layer forming step SA2, and a bonding step SA3, a thin film forming step which includes a resistor forming step SA4, an electrode forming step SA5, and a protective film forming step SA6, and a surrounding metal layer forming step SA7.

Figure 5A:
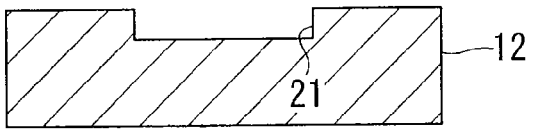
FIG. 5A is a vertical sectional view illustrating a recess forming step.

In the recess forming step SA1, the recess 21 is formed in at least one of a surface of the support substrate 12 and a surface of the upper substrate 14 which are opposed to each other. In this embodiment, as illustrated in FIG. 5A, the recess 21 is processed in a surface of a glass substrate (support substrate 12) having a certain thickness at a position to be opposed to the heat generating resistor 15 formed in the resistor forming step SA4. The recess 21 is formed by, for example, sandblasting, dry etching, wet etching, or laser processing the surface of the support substrate 12.

When the support substrate 12 is sandblasted, the surface of the support substrate 12 is covered with a photoresist material. After the photoresist material is exposed with light using a photomask having a predetermined pattern, portions other than a region in which the recess 21 is to be formed is solidified. After that, the surface of the support substrate 12 is cleaned and the photoresist material which is not solidified is removed to obtain an etching mask having an etching window formed in a region thereof in which the recess 21 is to be formed. By sandblasting the surface of the support substrate 12 in this state, the recess 21 having a predetermined depth is formed.

Further, when the support substrate 12 is etched, similarly to the case of the sandblasting, on the surface of the support substrate 12, there is formed an etching mask having an etching window formed in a region thereof in which the recess 21 is to be formed. By etching the surface of the support substrate 12 in this state, the recess 21 having a predetermined depth is formed. In the case of a glass substrate, wet etching using a hydrofluoric acid-based etchant may be carried out. Other than these, dry etching such as reactive ion etching (RIE) or plasma etching may also be used.

Figure 5B:
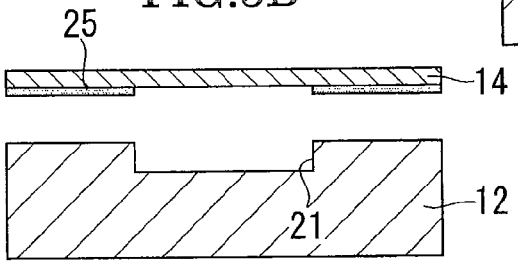
FIG. 5B is a vertical sectional view illustrating an intermediate metal layer forming step.

In the intermediate metal layer forming step SA2, the intermediate metal layer 25 is formed on at least one of the surface of the support substrate 12 and the surface of the upper substrate 14 which are opposed to each other. In this embodiment, as illustrated in FIG. 5B, a metallic body layer (intermediate metal layer 25) is formed on the surface of a thin glass (upper substrate 14) opposed to the support substrate 12 except for a region opposed to the recess 21. It is preferred to use, as the upper substrate 14, one having a surface roughness of 100 nm or less.

The intermediate metal layer 25 is formed in a desired shape by, for example, forming an oxidizing metal thin film such as Al, Si, Cr, Ti, or Ni or a laminated film thereof on the surface of the upper substrate 14 opposed to the support substrate 12 by a thin film forming method such as sputtering, chemical vapor deposition (CVD), or vapor deposition, and shaping the oxidizing metal thin film or the laminated film by lift-off, etching, or the like.

Figure 5C:
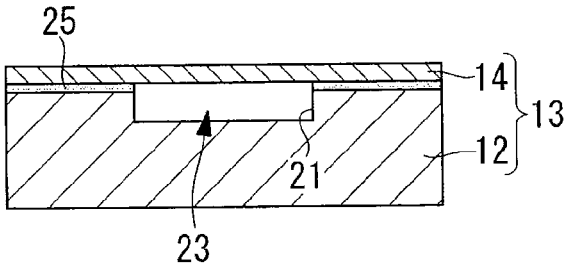
FIG. 5C is a vertical sectional view illustrating a bonding step.

In the bonding step SA3, as illustrated in FIG. 5C, the support substrate 12 and the upper substrate 14 are bonded together in a laminated state with the intermediate metal layer 25 sandwiched therebetween so as to enclose the opening of the recess 21. By enclosing the recess 21 in this way, the laminated substrate 13 in which the cavity portion 23 is formed in the bonded portion of the support substrate 12 and the upper substrate 14 is formed. In this case, the depth of the recess 21 is the thickness of the cavity portion 23, and thus, the thickness of the hollow heat insulating layer can be easily controlled.

Further, in the bonding step SA3, the support substrate 12 and the upper substrate 14 are bonded together with the intermediate metal layer 25 sandwiched therebetween by anode bonding. In the anode bonding, for example, by applying voltage of 500 V to 1 kV to the targets of the bonding under a state in which the targets are heated to about 300° C. to 500° C. to cause strong electrostatic attraction therebetween, the interface between the targets of the bonding are chemically bonded together to bond the targets together. Bonding by anode bonding of the support substrate 12 and the upper substrate 14 is carried out at a temperature under the softening point of the support substrate 12 and the upper substrate 14. Therefore, the accuracy of form of the support substrate 12 and the upper substrate 14 can be maintained, and the reliability is high.

A thin glass (upper substrate 14) having a thickness of 100 μm or less is difficult to manufacture and handle, and also expensive. Therefore, it is also possible to, instead of directly bonding the thin upper substrate 14 to the support substrate 12, first, bond to the support substrate 12 the upper substrate 14 which is thick enough to be easily manufactured and handled, and then, process the upper substrate 14 into a desired thickness by etching, grinding, or the like (thinning step). In this way, the extremely thin upper substrate 14 can be formed on the surface of the support substrate 12 easily and at low cost.

The upper substrate 14 can be etched by the various kinds of etching methods used in forming the recess 21 described above. Further, the upper substrate 14 can be ground using, for example, chemical mechanical polishing (CMP) used in high precision grinding of a semiconductor wafer or the like.

Figure 5D:
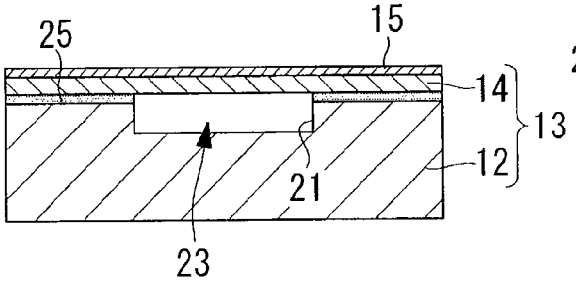
FIG. 5D is a vertical sectional view illustrating a resistor forming step.
Figure 5E:
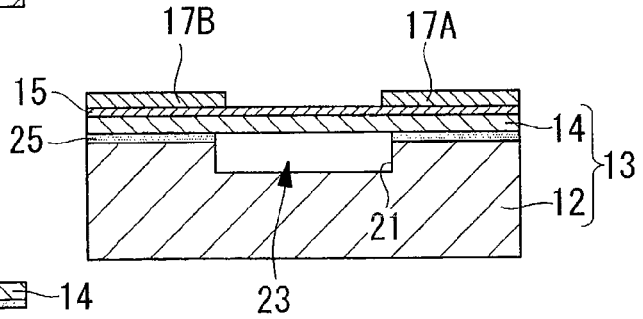
FIG. 5E is a vertical sectional view illustrating an electrode forming step.
Figure 5F:
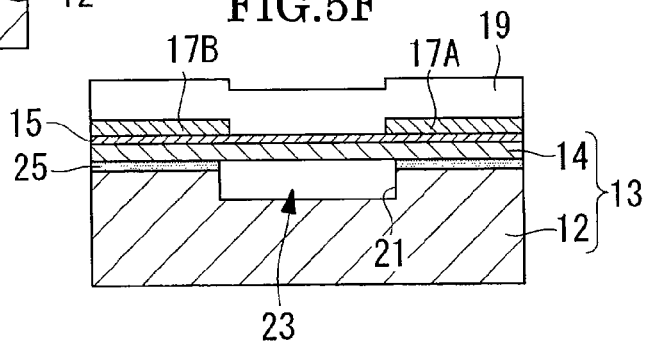
FIG. 5F is a vertical sectional view illustrating a protective film forming step.

Then, in the resistor forming step SA4, as illustrated in FIG. 5D, the heat generating resistor 15 is formed on the other surface of the upper substrate 14 in the laminated substrate 13 formed in this way, and then, in the electrode forming step SA5, as illustrated in FIG. 5E, the electrode portions 17A and 17B are formed, and then, in the protective film forming step SA6, as illustrated in FIG. 5F, the protective film 19 is formed. The heat generating resistor 15, the electrode portions 17A and 17B, and the protective film 19 can be manufactured using a method of manufacturing these members in a conventional thermal head.

Specifically, in the resistor forming step SA4, by forming a thin film of the material of the heat generating resistor on the upper substrate 14 using a thin film forming method such as sputtering, chemical vapor deposition (CVD), or vapor deposition, and shaping the thin film formed of the heat generating resistor material using lift-off, etching, or the like, the heat generating resistor 15 of a desired shape is formed.

In the electrode forming step SA5, similarly to the case of the resistor forming step SA4, by forming a film of the wiring material on the upper substrate 14 by sputtering, vapor deposition, or the like and shaping the film using lift-off or etching, by screen printing the wiring material and then baking the wiring material, or the like, the individual electrode 17A and the common electrode 17B of desired shapes are formed.

In the protective film forming step SA6, after the heat generating resistor 15 and the electrode portions 17A and 17B are formed, a film of the protective film material is formed on the upper substrate 14 by sputtering, ion plating, CVD, or the like to form the protective film 19.

Figure 5G:
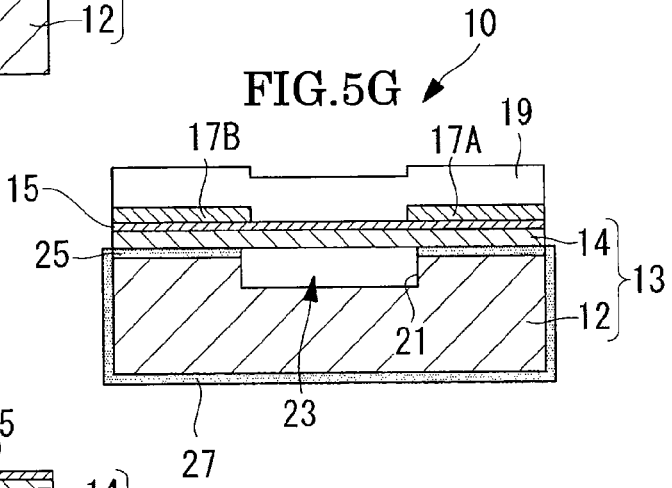
FIG. 5G is a vertical sectional view illustrating a surrounding metal layer forming step.

Finally, in the surrounding metal layer forming step SA7, as illustrated in FIG. 5G, the surrounding metal layer 27 is formed from the side surfaces to the lower surface of the support substrate 12. In this case, the surrounding metal layer 27 provided on the side surfaces of the support substrate 12 is brought into contact with the intermediate metal layer 25.

The surrounding metal layer 27 is formed by, for example, forming a thin film of a metal such as Au, Al, Cu, Si, Cr, Ti, or Ni as described above or a laminated film thereof by a thin film forming method such as sputtering, chemical vapor deposition (CVD), vapor deposition, or plating. As the surrounding metal layer 27, a metal material having a high thermal conductivity, such as Au, Al, or Cu, is particularly preferred.

Through the steps described above, the thermal head 10 is completed, in which the laminated substrate 13 includes the intermediate metal layer 25 along the bonded portion of the support substrate 12 and the upper substrate 14, and the side surfaces and the lower surface of the support substrate 12 are covered with the surrounding metal layer 27.

Next, actions of the thermal head 10 manufactured in this way and of the thermal printer 100 are described.

When printing is carried out on the thermal paper 3 using the thermal printer 100 according to this embodiment, first, voltage is applied selectively to the individual electrodes 17A of the thermal head 10 on one side. This causes current to flow through a heat generating resistor 15 connected between the selected individual electrode 17A and the common electrode 17B opposed thereto, to thereby cause the corresponding heat generating portion 15*a* to generate heat.

Then, the pressure mechanism 8 is actuated to press the thermal head 10 against the thermal paper 3 fed by the platen roller 4. The platen roller 4 rotates about an axis in parallel with the direction of arrangement of the heat generating resistors 15 to feed the thermal paper 3 in a Y direction orthogonal to the direction of arrangement of the heat generating resistors 15. By pressing the heat generating portion 15*a* of the heat generating resistor 15 against the thermal paper 3, the thermal paper 3 exhibits a color to carry out printing.

In this case, in the thermal head 10, the cavity portion 23 of the laminated substrate 13 functions as a hollow heat insulating layer, and thus, the amount of heat generated by the heat generating portion 15*a* and transferred via the upper substrate 14 as a thermal storage layer to the support substrate 12 side can be reduced to reduce the thermal capacity. This enables efficient use of heat generated by the heat generating resistor 15 to improve the heat generating efficiency.

On the other hand, heat transferred from the upper substrate 14 side via the cavity portion 23 to the support substrate 12 side is transferred via the intermediate metal layer 25 and the surrounding metal layer 27 formed of a metal material having a high thermal conductivity to the lower surface side of the laminated substrate 13. By fixing the lower surface of the laminated substrate 13 onto the heat sink 9 for dissipating heat, heat stored in the support substrate 12 can be efficiently dissipated to facilitate cooling of the heat generating resistor 15.

Therefore, in the thermal head 10 and the thermal printer 100 according to this embodiment, by, with the cavity portion 23 of the laminated substrate 13, reducing the thermal capacity to improve the response characteristic during heating time for heating the heat generating resistor 15 and reducing the thermal storage effect of the support substrate 12 to improve the response characteristic during non-heating time for cooling the heat generating resistor 15, both reduced power consumption and higher printing speed can be attained. Further, by forming the support substrate 12 and the upper substrate 14 of the same glass material, difference in thermal expansion coefficient between the substrates can be eliminated to prevent warpage and distortion of the heat generating resistor 15 due to generated heat, thereby maintaining high print quality.

This embodiment can be modified as follows.

Figure 6:
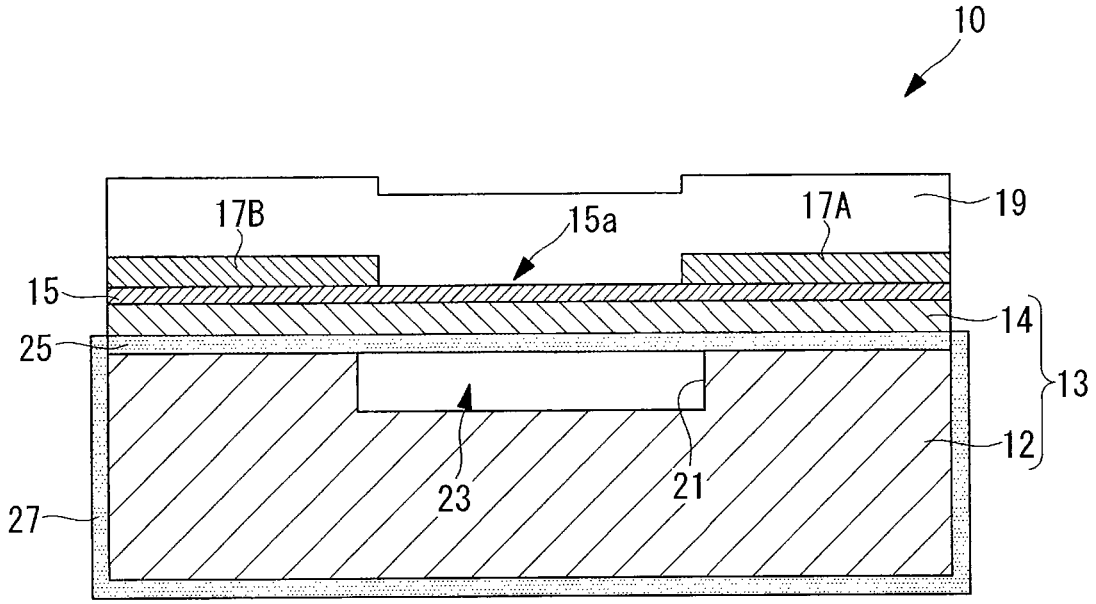
FIG. 6 is a vertical sectional view of a thermal head according to a first modified example of the embodiment of the present invention.

In this embodiment, the intermediate metal layer 25 is formed in the entire region of the opposed surface of the upper substrate 14 and the support substrate 12 except for the region of the recess 21. In a first modified example, as illustrated in FIG. 6, the intermediate metal layer 25 may be formed in the entire region of the surface of the upper substrate 14 in the bonded portion of the support substrate 12 and the upper substrate 14.

Figure 7:
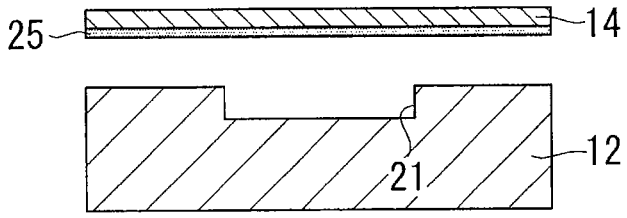
FIG. 7 is a vertical sectional view illustrating an intermediate metal layer forming step in a method of manufacturing the thermal head according to the first modified example of the embodiment of the present invention.

In a method of manufacturing the thermal head 10 according to this modified example, as illustrated in FIG. 7, in the intermediate metal layer forming step SA2, for example, the metallic body layer (intermediate metal layer 25) is formed in the entire region of the surface of the thin glass (upper substrate 14) opposed to the support substrate 12. Other steps are similar to those illustrated in FIG. 5A and FIG. 5C to FIG. 5G.

In the thermal head 10 according to this modified example, the high thermal conductivity of the intermediate metal layer 25 can further reduce the thermal storage effect of the upper substrate 14. This can attain higher printing speed. Further, the necessity of patterning the intermediate metal layer 25 on the upper substrate 14 is eliminated, which can facilitate the manufacture.

In this modified example, a case in which the upper substrate 14 does not have a recess formed therein is illustrated and described. When a recess is formed in the surface of the upper substrate 14 opposed to the support substrate 12, the intermediate metal layer 25 is formed in the entire region of the surface of the upper substrate 14 opposed to the support substrate 12. Specifically, the intermediate metal layer 25 is formed on the opposed surface of the upper substrate 14, that is, on the bonded surface and inner wall surfaces of the recess (side surfaces and a bottom surface of the recess).

Figure 8:
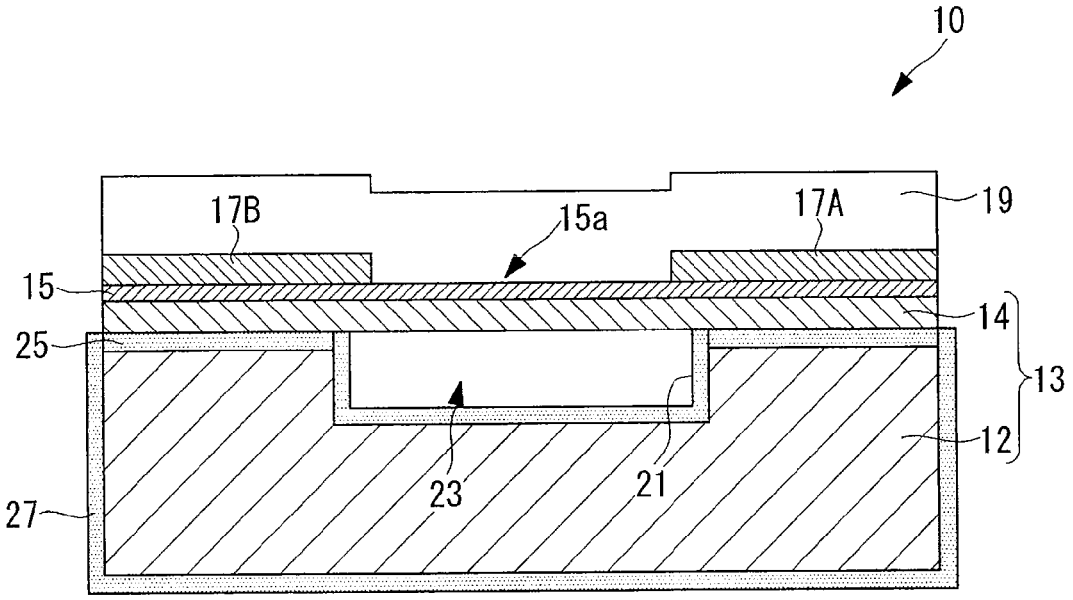
FIG. 8 is a vertical sectional view of a thermal head according to a second modified example of the embodiment of the present invention.

Next, in a second modified example, as illustrated in FIG. 8, the intermediate metal layer 25 may be formed on the entire region of the surface of the support substrate 12 in the bonded portion of the support substrate 12 and the upper substrate 14. Specifically, in this modified example, the intermediate metal layer 25 may be formed on the bonded surface of the surface of the support substrate 12 and on the inner wall surfaces of the recess 21.

Figure 9:
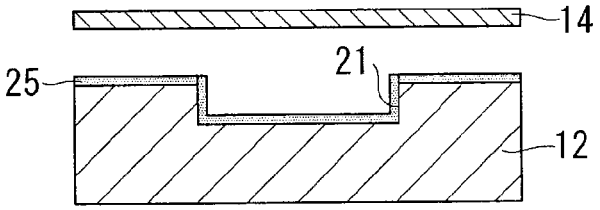
FIG. 9 is a vertical sectional view illustrating an intermediate metal layer forming step in a method of manufacturing the thermal head according to the second modified example of the embodiment of the present invention.

In a method of manufacturing the thermal head 10 according to this modified example, as illustrated in FIG. 9, in the intermediate metal layer forming step SA2, for example, the intermediate metal layer 25 is formed in the entire region of the opposed surface of the surface of the support substrate 12 and the side surfaces and the bottom surface of the recess 21. Other steps are similar to those illustrated in FIG. 5A and FIG. 5C to FIG. 5G.

According to this modified example, the high thermal conductivity of the intermediate metal layer 25 can reduce the thermal storage effect of the support substrate 12. This can attain higher printing speed. Further, the necessity of patterning the intermediate metal layer 25 on the upper substrate 14 is eliminated, which can facilitate the manufacture.

In this modified example, a case in which the recess 21 is formed in the surface of the support substrate 12 is illustrated and described. When a recess is formed in the upper substrate 14 and the recess 21 is not formed in the support substrate 12, the intermediate metal layer 25 is formed in the entire region of the surface of the support substrate 12 opposed to the upper substrate 14.

Figure 10:
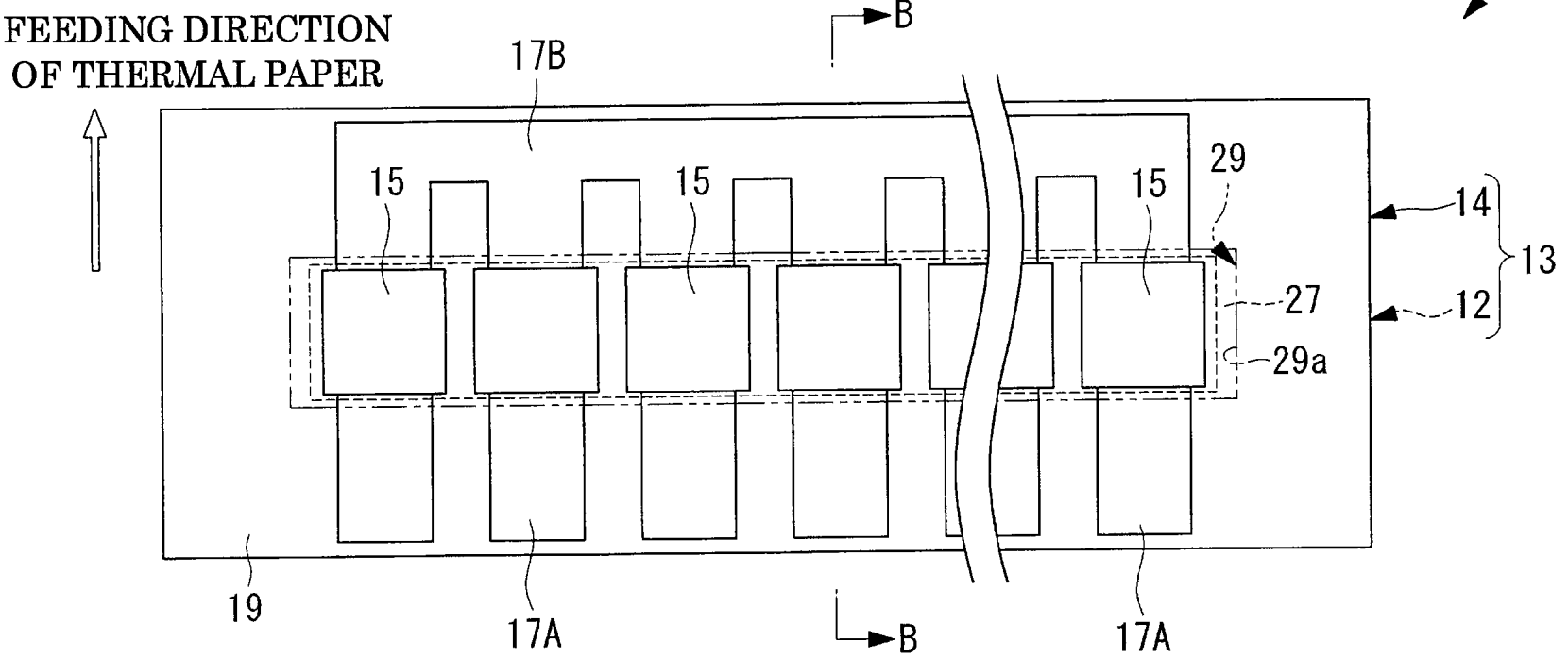
FIG. 10 is a plan view of a thermal head according to a third modified example of the embodiment of the present invention seen from the protective film side in the lamination direction.
Figure 11:
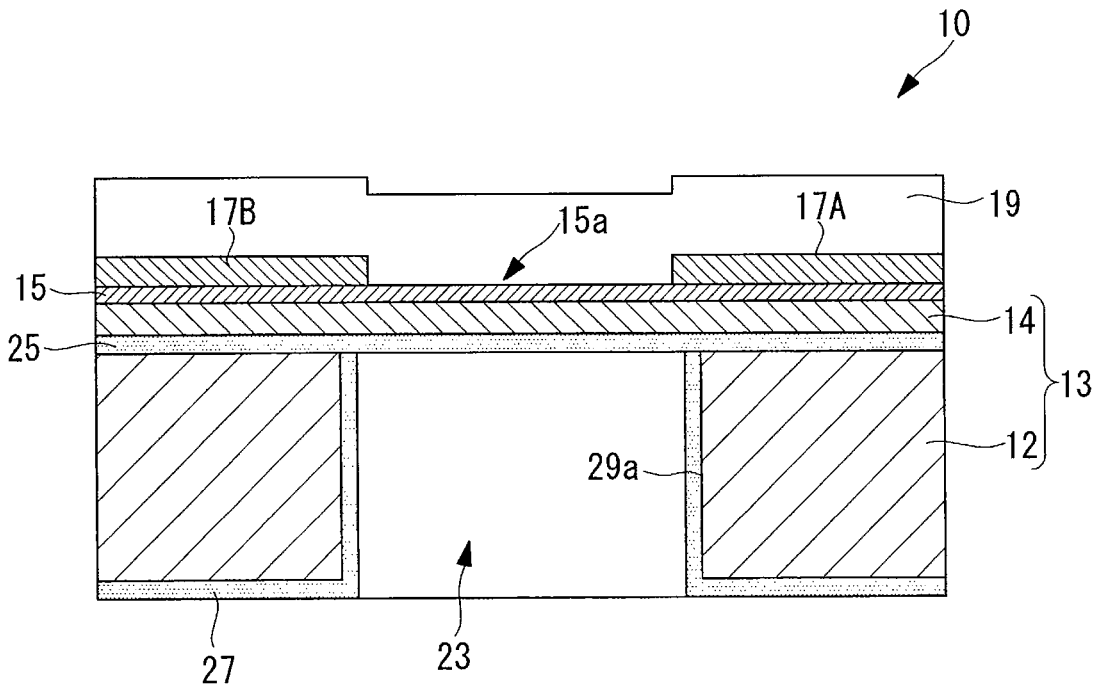
FIG. 11 is a vertical sectional view of the thermal head taken along the line B-B of FIG. 10.

In this embodiment, the surrounding metal layer 27 is formed so as to extend toward the lower surface via the side surfaces of the support substrate 12. In a third modified example, as illustrated in FIG. 10 and FIG. 11, the support substrate 12 may have a through hole 29 which passes through the support substrate 12 in the thickness direction thereof to form a recess, and the surrounding metal layer 27 may be formed so as to extend toward the lower surface via inner wall surfaces 29*a* of the through hole 29 in the support substrate 12.

Specifically, the through hole 29 is formed so that the recess opens also to the side of the lower surface of the support substrate 12.

The surrounding metal layer 27 is formed in the entire region of the inner wall surfaces 29*a* of the through hole 29 and in the entire region of the lower surface of the support substrate 12. Further, one end of the surrounding metal layer 27 formed on the inner wall surfaces 29*a* is provided in contact with the intermediate metal layer 25 over the whole perimeter of the through hole 29.

Figure 12:
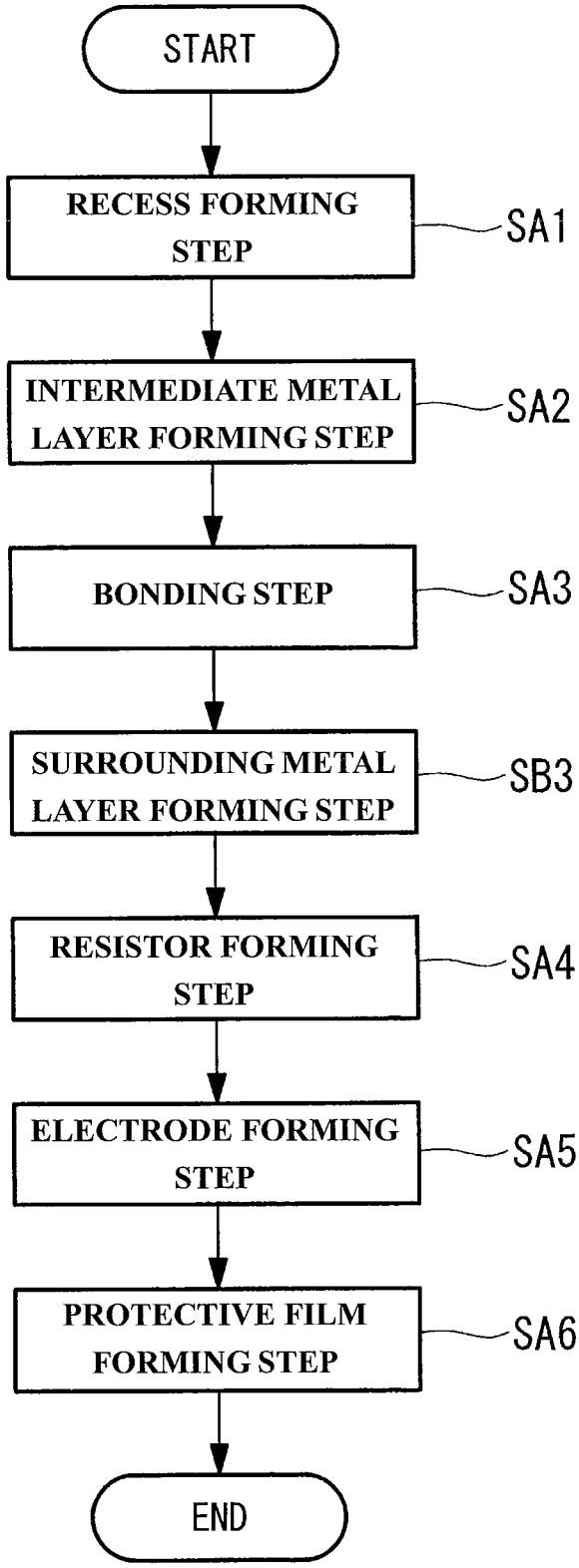
FIG. 12 is a flow chart illustrating a method of manufacturing the thermal head illustrated in FIG. 10.
Figure 13A:
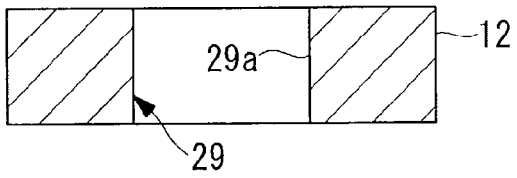
FIG. 13A is a vertical sectional view illustrating a recess forming step.

A method of manufacturing the thermal head 10 according to this modified example is as illustrated in a flow chart of FIG. 12. Specifically, in the recess forming step SA1, as illustrated in FIG. 13A, the through hole 29 which passes through the support substrate 12 in the thickness direction is processed in a region of the surface of the glass substrate (support substrate 12) having a certain thickness, in which the heat generating resistor 15 is to be formed.

The method of forming the through hole 29 is similar to the method of forming the recess 21 illustrated in FIG. 5A except that the support substrate 12 is penetrated in the thickness direction thereof, and the through hole 29 is formed by sandblasting, dry etching, wet etching, or laser processing the surface of the support substrate 12.

Figure 13B:
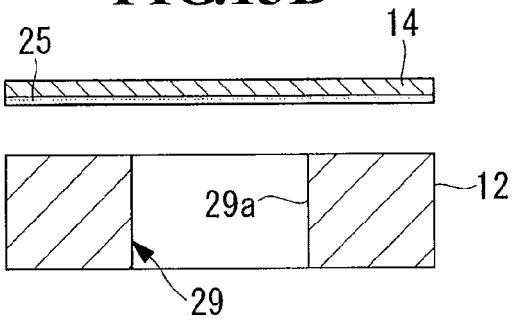
FIG. 13B is a vertical sectional view illustrating an intermediate metal layer forming step.
Figure 13C:
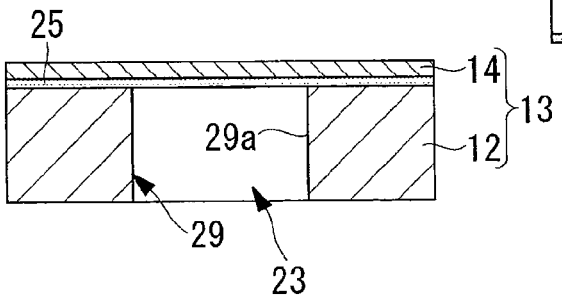
FIG. 13C is a vertical sectional view illustrating a bonding step.

The intermediate metal layer forming step SA2 and the bonding step SA3 are, as illustrated in FIG. 13B and FIG. 13C, similar to the steps illustrated in FIG. 5B and FIG. 5C.

Figure 13D:
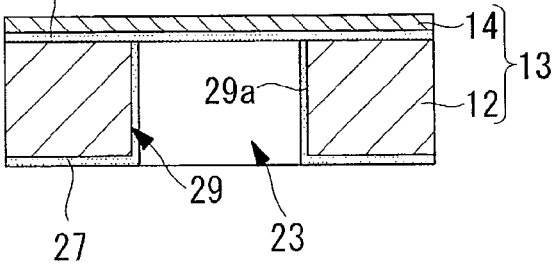
FIG. 13D is a vertical sectional view illustrating a surrounding metal layer forming step.

Next, in a surrounding metal layer forming step SB3, as illustrated in FIG. 13D, the surrounding metal layer 27 is formed from the inner wall surfaces 29*a* of the through hole 29 to the lower surface of the support substrate 12. In this case, the surrounding metal layer 27 provided at one end of the inner wall surfaces 29*a* of the through hole 29 is brought into contact with the intermediate metal layer 25. The method of forming the surrounding metal layer 27 is similar to the surrounding metal layer forming step SA7 except that the surrounding metal layer 27 is formed on the inner wall surfaces 29*a* of the through hole 29.

Figure 13E:
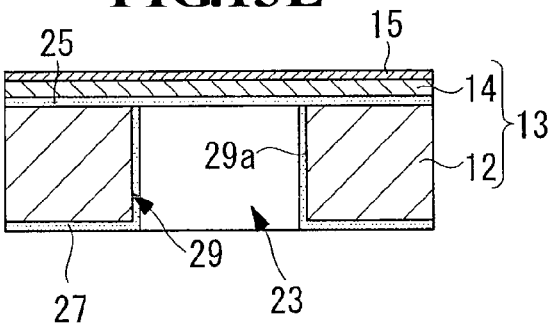
FIG. 13E is a vertical sectional view illustrating a resistor forming step.
Figure 13F:
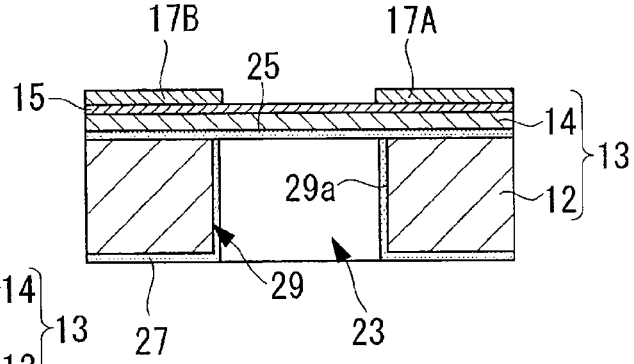
FIG. 13F is a vertical sectional view illustrating an electrode forming step.
Figure 13G:
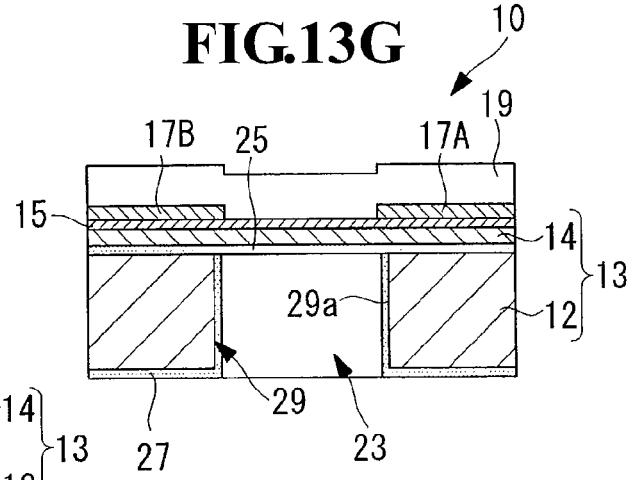
FIG. 13G is a vertical sectional view illustrating a protective film forming step.

Next, as illustrated in FIG. 13E to FIG. 13G, similarly to the steps illustrated in FIG. 5D to FIG. 5F, in the resistor forming step SA4, the heat generating resistor 15 is formed on the other surface of the upper substrate 14 in the laminated substrate 13, in the electrode forming step SA5, the electrode portions 17A and 17B are formed, and, in the protective film forming step SA6, the protective film 19 is formed, all in this order.

According to this modified example, heat transferred to the support substrate 12 side is dissipated from the lower surface of the support substrate 12 via the surrounding metal layer 27 formed on the inner wall surfaces 29*a* of the through hole 29 formed immediately below the heat generating resistor 15. In other words, differently from a case in which heat is transferred by the intermediate metal layer 25 in a plane direction of the support substrate 12 and then transferred in the thickness direction of the support substrate 12, heat is transferred through the intermediate metal layer 25 in the thickness direction and then transferred in the thickness direction of the support substrate 12. By reducing the transferred distance of the heat flow, the heat dissipation efficiency by the surrounding metal layer 27 can be improved to further reduce the thermal storage effect of the support substrate 12.

Note that, even in a batch process in which a plurality of the thermal heads 10 are manufactured at a time, when the surrounding metal layer 27 is formed on the side surfaces of the support substrate 12, the surrounding metal layer forming step SA7 is required to be carried out after the thermal heads 10 are separated one by one. On the other hand, according to this modified example, the intermediate metal layer 25 and the surrounding metal layer 27 can be formed before the thermal heads 10 are separated one by one, which is suitable for mass production.

In this modified example, as illustrated in FIG. 11, a structure in which the intermediate metal layer 25 is formed in the entire region of the surface of the upper substrate 14 opposed to the support substrate 12 is illustrated and described, but the intermediate metal layer 25 may be formed in the entire region of the surface of the upper substrate 14 opposed to the support substrate 12 except for the region of the through hole 29.

Figure 14:
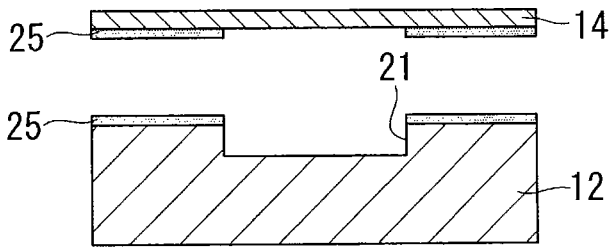
FIG. 14 is a vertical sectional view of a thermal head according to a fourth modified example of the embodiment of the present invention.

Further, in this embodiment, the support substrate 12 and the upper substrate 14 are bonded together with the intermediate metal layer 25 sandwiched therebetween by anode bonding. In a fourth modified example, both the support substrate 12 and the upper substrate 14 may each include the intermediate metal layer 25 on the bonded surface thereof, and, in the bonding step SA3, as illustrated in FIG. 14, the support substrate 12 and the upper substrate 14 may be bonded together by eutectic bonding or diffusion bonding of the intermediate metal layers 25.

In the case of diffusion bonding, in the intermediate metal layer forming step SA2, appropriate metal materials are used to form the intermediate metal layers 25 so that, in the bonding step SA3, bonding of Au—Ag, Au—Al, or Au—Au is carried out.

In the case of eutectic bonding, in the intermediate metal layer forming step SA2, appropriate metal materials are used to form the intermediate metal layers 25 so that, in the bonding step SA3, bonding of Sn—Au is carried out. In a eutectic alloy, metals or compounds therein having different melting points crystallize out at the same time under a state of being molten or finely mixed at a predetermined temperature which is lower than the melting points of the two substances, and thus, by using as the intermediate metal layers a metal material forming the eutectic, bonding of the support substrate 12 and the upper substrate 14 can be carried out at a low temperature (for example, 250° C.).

In anode bonding, as the material of the support substrate 12 and the upper substrate 14, a glass material which contains movable ions, such as Pyrex glass (trademark) or soda-lime glass, has to be used, but using eutectic bonding or diffusion bonding enables selection of various materials.

The embodiment of the present invention is described in detail in the above with reference to the attached drawings, but the specific structure is not limited to the embodiment, and design change and the like within the gist of the present invention are also within the scope of the present invention.

For example, the present invention is not limited to the above-mentioned embodiment and modified examples. The present invention may also be applied to an embodiment in which the embodiment and the modified examples are appropriately combined, and the present invention is not specifically limited.

Further, in the above-mentioned embodiment and modified examples, the surrounding metal layer 27 is formed in the entire region of the lower surface and the entire region of the side surfaces of the support substrate 12, or in the entire region of the lower surface of the support substrate 12 and the entire region of the inner wall surfaces 29*a* of the through hole 29, but it is enough that the surrounding metal layer 27 is continuous from the one end thereof provided in contact with the intermediate metal layer 25 to the other end thereof provided on the lower surface of the support substrate 12, and thus, the surrounding metal layer 27 may be formed in the shape of a line on the lower surface and a side surface of the support substrate 12 or on the lower surface of the support substrate 12 and an inner wall surface 29*a* of the through hole 29.

What is claimed is:

1. A thermal head comprising:

a laminated substrate including a support substrate and an upper substrate each comprising a glass material and at least one of which includes a recess in a surface thereof, the support substrate and the upper substrate in a laminated state so as to enclose the recess, the recess in the laminated substrate defining a cavity portion between bonded portions of the support substrate and the upper substrate;

a heat generating resistor on a surface of the upper substrate in the laminated substrate at a position opposed to the cavity portion;

a pair of electrode portions connected to each of both ends of the heat generating resistor, for supplying electric power to the heat generating resistor;

an intermediate metal layer sandwiched between the support substrate and the upper substrate and bonded to the support substrate and the upper substrate in a laminated state; and a surrounding metal layer in contact with side edges of the intermediate metal layer and overlying a surface of the support substrate and extending to a surface of the support substrate opposite to the intermediate metal layer.

2. A thermal head according to claim 1, wherein: the support substrate includes a through hole which passes through the support substrate in a thickness direction thereof to form the recess; and the surrounding metal layer extends via an inner wall surface of the through hole toward a surface of the support substrate which is opposite to the bonded portion.

3. A thermal head according to claim 1, wherein the upper substrate and the support substrate comprise a glass material that includes movable ions, and the substrates are bonded together through intermediation of the intermediate metal layer by anodic bonding.

4. A thermal head according to claim 1, wherein the upper substrate and the support substrate each include the intermediate metal layer on bonded surfaces thereof, and are bonded together by one of eutectic bonding or diffusion bonding of the intermediate metal layer.

5. A thermal head according to claim 1, wherein the surrounding metal layer is formed in an entire region of the surface of the support substrate except for the bonded portion.

6. A thermal head according to claim 1, wherein the intermediate metal layer overlies an entire region of the surface of the upper substrate in the bonded portion.

7. A thermal head according to claim 1, wherein the intermediate metal layer overlies an entire region of the surface of the support substrate in the bonded portion.

8. A thermal head comprising:

a laminated substrate including a support substrate and an upper substrate each comprising a glass material and a recess resides in the surface of the support substrate, the support substrate and the upper substrate in a laminated state so as to enclose the recess, the recess in the laminated substrate defining a cavity portion between bonded portions of the support substrate and the upper substrate;

a heat generating resistor on a surface of the upper substrate in the laminated substrate at a position opposed to the cavity portion;

a pair of electrode portions connected to each of both ends of the heat generating resistor, for supplying electric power to the heat generating resistor;

an intermediate metal layer sandwiched between the support substrate and the upper substrate and bonded thereto in a laminated state, the intermediate metal layer overlying the surface of the support substrate in the bonded portion and an inner wall surface of the recess; and a surrounding metal layer in contact with the intermediate metal layer and overlying a surface of the support substrate and extending to a surface thereof opposite to the bonded portion of the upper substrate.

9. A thermal head according to claim 2, wherein the upper substrate and the support substrate are formed of a glass material which contains movable ions and are bonded together through intermediation of the intermediate metal layer by anode bonding.

10. A thermal head according to claim 9, wherein the surrounding metal layer is formed in an entire region of the surface of the support substrate except for the bonded portion.

11. A thermal head according to claim 9, wherein the intermediate metal layer is formed in an entire region of the surface of the upper substrate in the bonded portion.

12. A thermal head according to claim 9, wherein the intermediate metal layer is formed in an entire region of the surface of the support substrate in the bonded portion.

13. A thermal head according to claim 9, wherein: the recess is formed in the surface of the support substrate; and the intermediate metal layer is formed on the bonded surface of the support substrate in the bonded portion and on an inner wall surface of the recess.

14. A thermal head according to claim 2, wherein the upper substrate and the support substrate each include the intermediate metal layer on the bonded surface thereof, and are bonded together by one of eutectic bonding and diffusion bonding of the intermediate metal layers.

15. A thermal head according to claim 14, wherein the surrounding metal layer is formed in an entire region of the surface of the support substrate except for the bonded portion.

16. A thermal head according to claim 14, wherein the intermediate metal layer is formed in an entire region of the surface of the upper substrate in the bonded portion.

17. A thermal head according to claim 14, wherein the intermediate metal layer is formed in an entire region of the surface of the support substrate in the bonded portion.

18. A thermal head according to claim 14, wherein: the recess is formed in the surface of the support substrate; and the intermediate metal layer is formed on the bonded surface of the support substrate in the bonded portion and on an inner wall surface of the recess.

19. A printer, comprising:

the thermal head according to claim 1; and a pressure mechanism for pressing a heat-sensitive recording medium against the heat generating resistor of the thermal head and feeding the heat-sensitive recording medium.

20. A thermal head according to claim 1, wherein the intermediate metal layer and the surrounding metal layer comprise a thermally conductive metal and define a heat conduction pathway for accumulated thermal energy in the upper substrate.

21. A thermal head according to claim 20, wherein the intermediate metal layer and the surrounding metal layer comprise one of Au, Al, Cu, Si, Cr, Ti, or Ni.

* * * * *